US005220791A

United States Patent [19]

Bulzomi

[11] Patent Number: 5,220,791

[45] Date of Patent: Jun. 22, 1993

[54] HEAT RESISTANT WORK SHOE

[76] Inventor: Antonio Bulzomi, 340 Ivy Ave., Westbury, N.Y. 11590

[21] Appl. No.: 890,831

[22] Filed: Jun. 1, 1992

[51] Int. Cl.[5] ..... A43B 7/06

[52] U.S. Cl. ..... 36/3 B; 36/3 A

[58] Field of Search ..... 36/3 A, 3 B, 3 R

[56] References Cited

U.S. PATENT DOCUMENTS

| | | | |
|---|---|---|---|
| 829,428 | 8/1906 | Pumilia | 36/3 R |
| 895,950 | 8/1908 | Von Bracht | 36/44 X |
| 922,094 | 5/1909 | Cummings | 36/3 B X |
| 1,211,542 | 1/1917 | Carolin | 36/3 R |
| 1,216,795 | 2/1917 | Gause | 36/3 A |
| 1,469,291 | 10/1923 | Bojtos | 36/3 A |
| 1,831,396 | 11/1929 | Rosenthal | 36/3 R |
| 1,890,433 | 12/1932 | Cohen | 36/3 A |
| 1,981,300 | 11/1934 | Berg | 36/3 B |
| 2,701,923 | 2/1955 | Toman | 36/3 R |
| 2,869,253 | 1/1959 | Sachs | 36/3 R |
| 3,284,930 | 11/1966 | Baldwin | 36/3 |
| 4,137,653 | 2/1979 | Famolare, Jr. | 36/3 B |
| 4,224,746 | 9/1980 | Kim | 36/3 |
| 4,249,319 | 2/1981 | Yoshida | 36/2.5 |
| 4,417,407 | 11/1983 | Fukuoka | 36/3 B |
| 4,438,573 | 3/1984 | McBarron | 36/3 B |
| 4,546,555 | 10/1985 | Spademan | 36/28 |
| 4,602,441 | 7/1986 | ElSakkof | 36/3 R |
| 4,654,982 | 4/1987 | Lee | 36/3 R |
| 4,658,515 | 4/1987 | Oatman | 36/44 |
| 4,760,651 | 8/1988 | Pon-Tzu | 36/3 B |
| 4,777,740 | 10/1988 | Akagi | 36/55 |
| 4,813,160 | 3/1989 | Kuzmetz | 36/3 R |
| 4,813,161 | 3/1989 | Lesley | 36/44 |
| 4,813,162 | 3/1989 | Harris | 36/88 |
| 4,831,859 | 3/1989 | Weiss | 36/43 |
| 4,835,883 | 6/1989 | Tetrault | 36/3 R |
| 4,887,368 | 12/1989 | Latzke | 36/98 X |
| 4,888,687 | 12/1989 | Solow | 36/3 R |
| 4,888,888 | 12/1989 | Ashton | 36/43 |
| 4,941,271 | 7/1990 | Lakie | 36/2.6 |
| 4,991,317 | 2/1991 | Lakic | 36/43 X |
| 4,993,173 | 2/1991 | Gardiner | 36/3 B |
| 4,999,932 | 3/1991 | Grim | 36/88 |
| 5,010,661 | 4/1991 | Chu | 36/3 B |
| 5,022,168 | 6/1991 | Jeppson, III et al. | 36/43 |
| 5,025,575 | 6/1991 | Lakie | 36/44 |
| 5,068,982 | 12/1991 | Devasthal | 36/4 |
| 5,086,572 | 2/1992 | Lee | 36/3 R |

*Primary Examiner*—Steven N. Meyers
*Assistant Examiner*—Ted Kavanaugh
*Attorney, Agent, or Firm*—Alfred M. Walker

[57] ABSTRACT

A heat resistant work shoe including a heat ventilating support for the shoe, the shoe having a plurality of holes for the ventilation of hot air, a reflective means provided at its lower part and the reflective means having concave surface coinciding with the curvature of the shoe upper in which it is located.

5 Claims, 3 Drawing Sheets

HEAT RESISTANT WORK SHOE

BACKGROUND OF THE INVENTION

The present invention relates to a heat resistant work shoe, enabling the wearer to tolerate working on hot asphalt and other heated working surfaces.

For work shoes to correctly isolate the user's foot from intense heat of hot asphalt, the work shoe must necessarily capture some of the conducted heat through the sole and out of the work shoe itself.

Prior art work shoes present a disadvantage since the said soles become hot on hot surfaces and they may even be unbearable to wear, especially in the case of working on hot asphalt materials which may reach 350 degrees F., with the consequent inconvenience and even a risk of burn blisters if the work shoes are exposed to hot asphalt for any considerable period of time.

Shoes incorporating simple or safe ventilating features are already known. Nevertheless, all those devices are based on the elimination of built-up body heat and perspiration. In addition, various shoes have built-in air chambers for the additional purpose of providing resilient air cushions within a shoe.

However, for various reasons the manufacture of high heat resistant work shoes is still necessary. Thus, shoes including parts which ventilate body heat air by means of outlet conduits and the like are known.

U.S. Pat. No. 4,438,573 to McBarron, U.S. Pat. No. 4,888,887 to Solow, and U.S. Pat. No. 4,999,932 to Grim describe air cushioned shoes with pumping members. The ventilating features of these shoes are to regulate the air pressure within the air cushioned reservoirs of the shoes.

U.S. Pat. No. 3,284,930 to Baldwin, U.S. Pat. No. 4,654,982 to Lee, and U.S. Pat. No. 4,941,271 to Lakie, describe boots, such as ski boots, with air and moisture ventilation chambers with outlet ventilation ports on the upper part of the boots.

U.S. Pat. No. 4,224,746 to Kim, U.S. Pat. No. 4,417,407 to Fukuoka, U.S. Pat. No. 4,602,441 of El Sakkaf, U.S. Pat. No. 4,760,651 to Pon-Tzu, U.S. Pat. No. 4,813,160 to Kurnetz, U.S. Pat. No. 4,993,173 to Gardiner, U.S. Pat. No. 4,835,883 to Tetrault, U.S. Pat. No. 5,010,661 to Chu and U.S. Pat. No. 5,025,575 to Lakie also disclose shoes or boots with air ventilation chambers wherein cool air is directed into the shoe or boot and warm moist body heat generated air is directed out of the shoe or boot.

U.S. Pat. No. 4,546,555 to Spaderman, U.S. Pat. No. 4,813,159 to Weiss, U.S. Pat. No. 4,813,161 to Lesley, U.S. Pat. No. 4,813,162 to Harris and U.S. Pat. No. 4,888,888 to Ashton disclose several cushioning features for footwear.

With respect to temperature control footwear, U.S. Pat. No. 4,249,319 to Yoshida, U.S. Pat. No. 4,658,515 to Oatman and U.S. Pat. No. 4,777,740 top Akagi describe shoes or boots designed to insulate and retain heat within the shoe or boot during cold environmental conditions.

Specifically, Yoshida '319 employs the introduction of exothermic heat inserts, Oatman '515 uses a chamber with insulated particles and heat reflective foil to reflect heat back to the foot of the wearer, and Akagi '740 uses closely stitched foam layers to retain heat in cold weather conditions.

These prior art patents have various ventilating features for shoes or boots, some with venting outlet ports located on various areas of the footwear, and some with air ventilating tubes or conduits to increase cushioned comfort and to reduce perspiration for the wearer.

However, none of the devices disclosed in these prior art patents utilize a reflective material specifically combined with a venting system to reduce inside intense shoe temperature build-up for the wearer of work shoes in high heat work environments, such as on hot asphalt road work.

The present invention includes a sole structure with a light upper inner sole separated from a heavier, lower inner sole by a heat collecting chamber, wherein the space between two soles includes a squeezable, bendable insert of numerous, preferably cylindrical, resilient supporting bodies to facilitate air circulation therebetween.

According to the preferred embodiment, an additional heat reflective means is constituted by a layer of cork material capable of dissipating some of the heat reflected away from the shoe by the reflective foil.

An advantageous characteristic, according to the invention, is that the thin reflective layer parts of the work shoe have a concavity, wherein they adapt themselves to the curvature of the upper part of the shoe upper in which they are placed.

BRIEF DESCRIPTION OF THE DRAWINGS

Other characteristics and advantages of the invention will become more apparent from the following description taken in conjunction with the accompanying drawings relative to non-limiting modes of embodiment, in which.

DESCRIPTION OF THE PREFERRED EMBODIMENT

Figure 1:
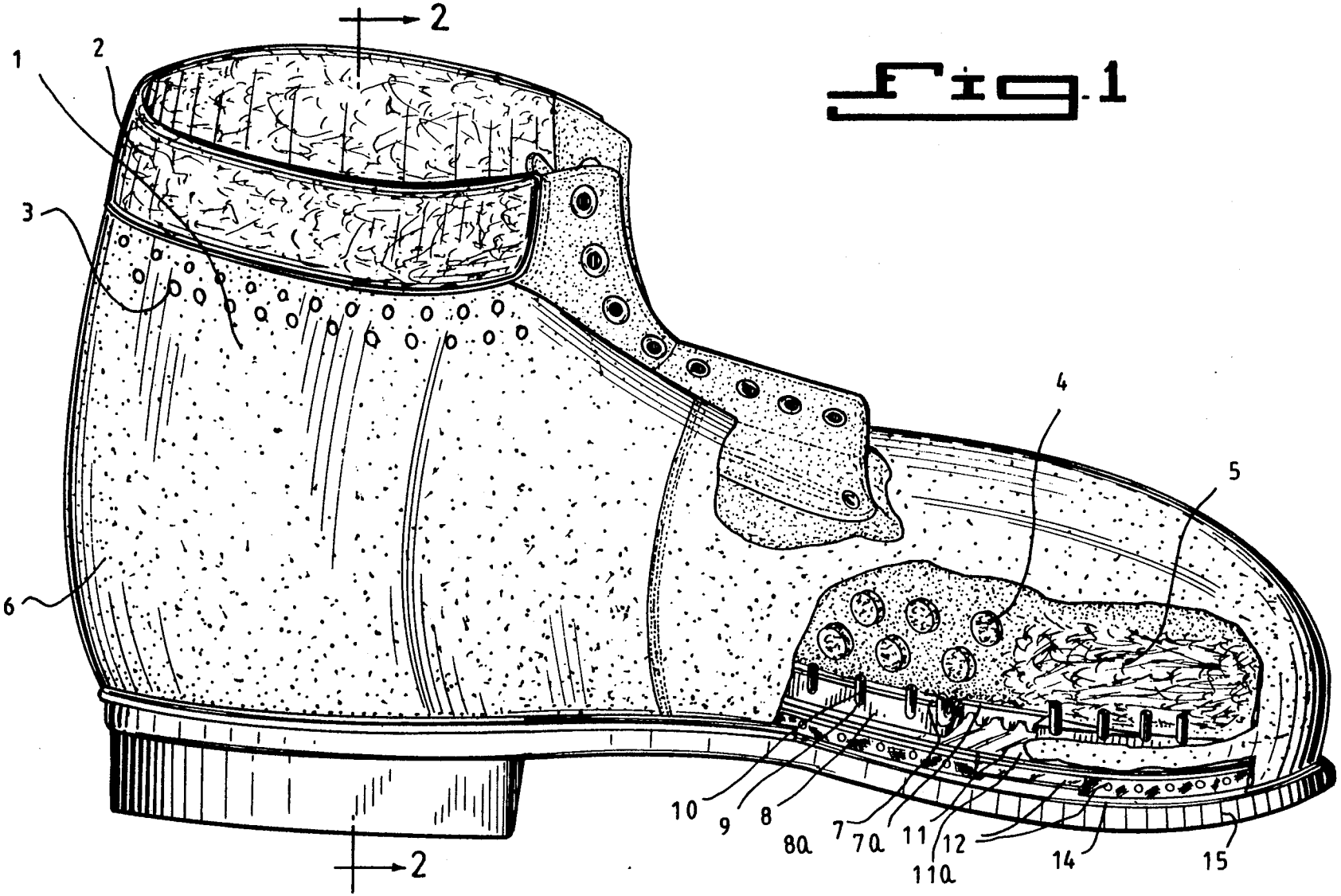
FIG. 1 is a perspective view of the heat vented work shoe, partly in section showing the present invention.
Figure 2:
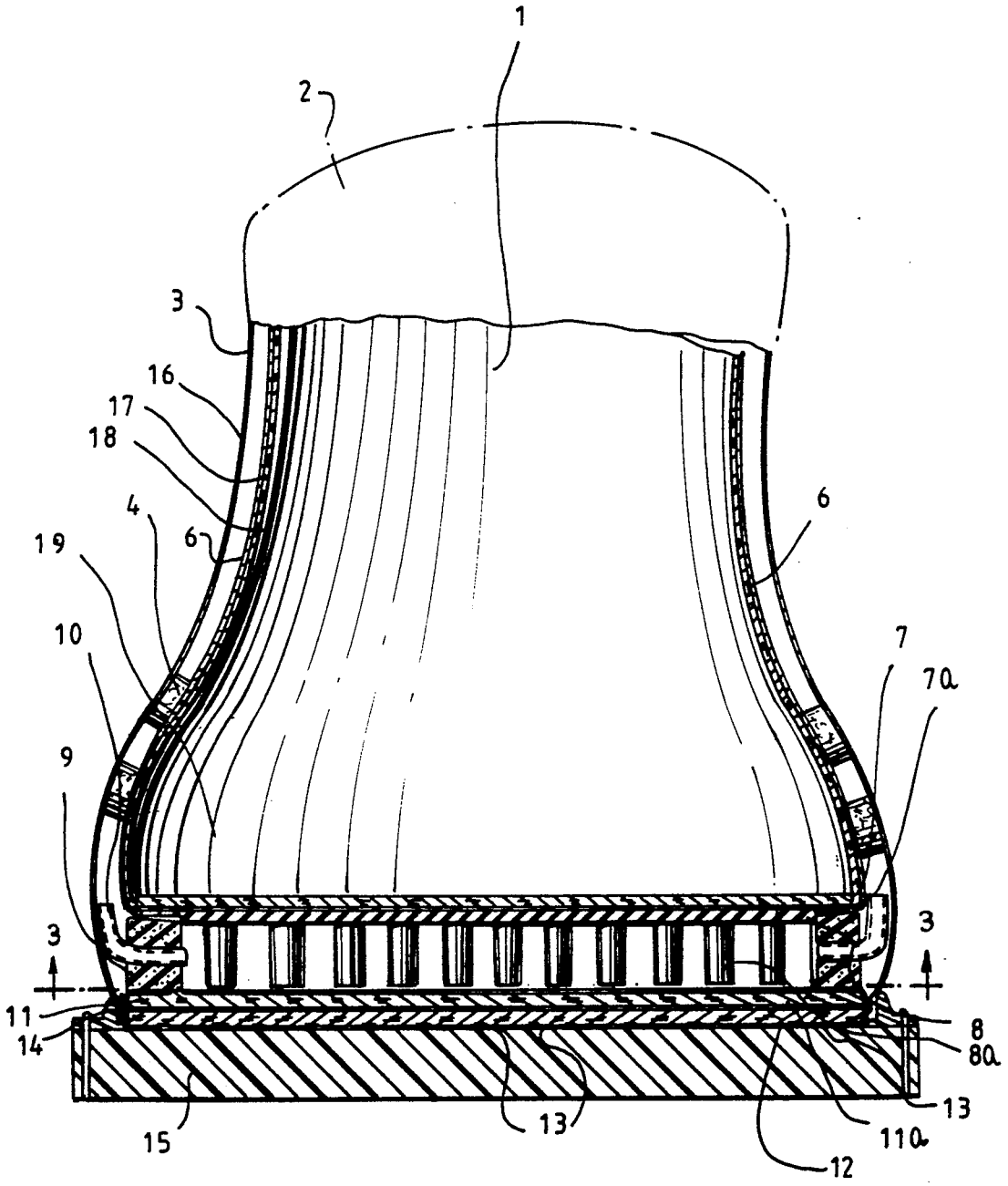
FIG. 2 is an elevational, side section view of the heat vented work shoe, taken along the plane 2—2 of FIG. 1.
Figure 3:
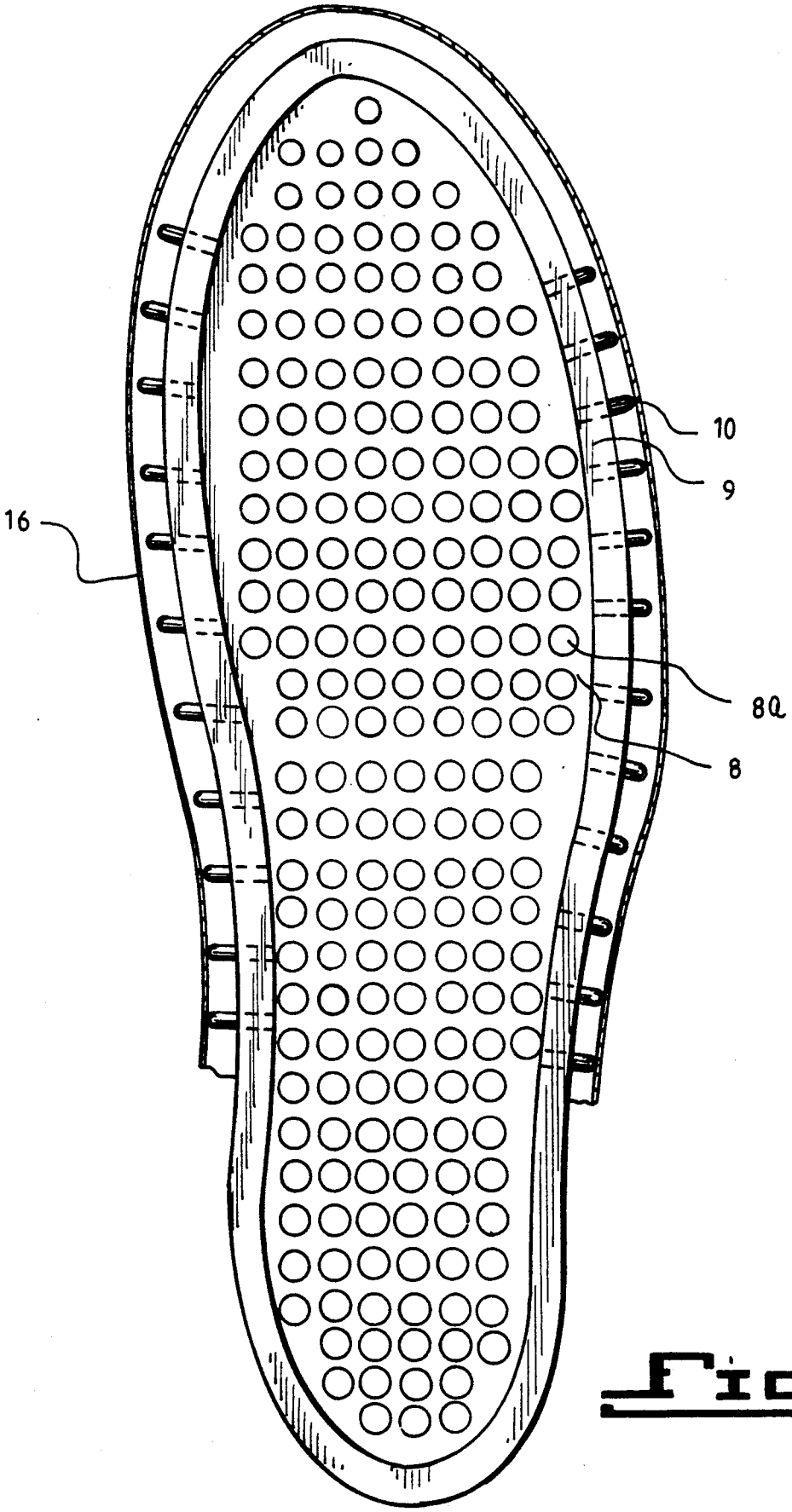
FIG. 3 is a bottom sectional view, taken along the plane 3—3 of FIG. 1 and along the plane of 3—3 of FIG. 2.

FIGS. 1, 2, and 3 show a preferred embodiment of this invention. A work shoe with two upper external portions constructed of leather, defining a cavity therebetween, has a midsole insert and tubes that permit air circulation within and out of the sole. As shown in FIGS. 1 and 2, the shoe includes a conventional upper work shoe body (1), designed to accommodate the foot of the wearer. The upper body (1), insulated on the interior with spongy material (18), fits comfortably around the foot of the wearer, with a snugly fitting collar (2). The upper shoe body has both an outer leather surface (16), constructed preferably of 4 oz. thick leather, and an inner leather surface (17), made preferably of 2 oz. thick leather. The outer leather surface (16) has two rows of ventilation holes (3) at the top of the shoe, beneath the collar (2).

Foam insulation and man-made lining or leather cover most of the inside of the shoe (18, 19), insulating the wearer's foot and providing cushioned comfort. Attached to the upper body in a conventional manner is the sole (15). The outsole portion is made out of standard neoprene, or an oil resistant rubber, and has treading on the bottom surface for gripping the ground.

The toe region of the shoe contains fibrous insulation material (5) between the outer (16) and inner (17)

leather surfaces. This insulation material (5) still permits air to circulate in the space between the two leather surfaces (16, 17).

The space between outer leather surface (16) and inner leather surface (17) also contains small, approximately ¼" diameter, circular spacing bodies (4), made of fabric or other soft material. The spacing bodies permit the circulation and flow of air from the sole, between the leather surfaces (16, 17), and out of the shoe through the rows of ventilation holes (3) at the top of the shoe.

Reflective material (6), such as perforated aluminum foil, envelopes the sides of the upper portion of the shoe, placed between the outer (16) and inner (17) leather surfaces. This reflective material (6) reflects radiant heat away form the wearer's foot. Such heat develops from the air flowing from the sole, as well as from the exterior asphalt bed and tar material that may adhere to the sides of the shoe. Reflective material (6) has a concavity, wherein it adapts itself to the curvature of the upper part of the shoe upper in which it is placed.

As illustrated in FIG. 2, the sole structure includes a lighter, upper inner sole (7) and-a heavier, lower inner sole (11). A soft, foam-insulated lining (19) covers the top of the upper inner sole, which contacts the wearer's foot and provides a comfortable surface. The space between the upper inner sole (7) and the lower inner sole (11) receives a squeezable, bendable insert (8), made of rubber or silicone. The insert (8) projects numerous, small, circular resilient supporting bodies (8*a*) of the same material, which permit air circulation within the sole. The supporting bodies (8*a*) have preferably a diameter of approximately ¼", a height of approximately ⅜" or ½", and spacing of approximately 5/16".

A sturdy wall (9) surrounds this compressible, insert (8) which insert (8) includes supporting bodies insert (8*a*). The wall (9) has a height of approximately ⅜" of ½", the same height as the rubber insert (8,8*a*) contained within. Glue staples attach this wall (9) to the shoe. Reflective materials (7*a*, 11*a*), similar to and contiguous with the reflective material (6) within the sides of the upper portion of the shoe 1, made of aluminum foil and attached by glue or other means to the upper inner sole and the lower inner sole, lie above and below the squeezable inserts (8, 8*a*).

The sturdy wall (9) contains numerous small holes, each hole holding within it a small, upwardly bent, plastic tube (10), preferably of ⅛" diameter of less than 1" in length. These holes with tubes (10) allow the inlet and outlet of air from the compression chamber created by the insert (8,) to the area between the leather upper surfaces (16, 17) of the shoe, resulting in the entry and exit of air through the ventilation holes (3) at the top of the shoe. The aluminum reflective materials (6, 7*a*, 11*a*) placed above and below the compression chamber and along the lower sides of the shoe reflects heat away from the wearer's foot.

Beneath the heavy, lower inner sole (11) lies a sheet of filling, made preferably of cork (12) to absorb some of the heat radiating upward through heavy outer sole (15). A fabric border (13), stitched to the bottom of the lower inner sole (11), surrounds this cork filling (12) and holds it in place. The heavy outer sole (15), which contacts the ground, is made of oil resistant material, such as standard neoprene. A plastic welt (14), stitched to the protruding ledge of the outer sole (15) and to the outer leather upper (16) of the shoe, protects the sole structure from dirt and moisture entry.

FIG. 3 shows a bottom view of the compressible rubber insert (8) and supporting bodies (8*a*), with the tubes (10) inserted through and out of the surrounding wall (9). As the wearer walks, he or she compresses the rubber supporting bodies (8*a*), forcing air up through the tubes (10), and out of the vents (3) at the top of the shoe. This flow of air deflects built-up heat away from the foot. As the wearer raises his or her foot, the compressible rubber bodies (8*a*) expand, bringing the cooler, outside air back through the vents (3) into the sole compartment.

A testing laboratory conducted a simulated use test, using a working prototype of the heat vented work shoe of the present invention. At the rate of approximately 20 cycles per minute, a T-Stopcock connected the shoe's air chamber alternately to a vacuum pump and to the outside atmosphere. The experiment involved pressing the shoe approximately one-half inch into a bed of heated sand. One set of tests used the vacuum cycling to simulate the pumping action that occurs during actual use of the shoe. Another set of tests ran without the vacuum cycling, to simulate only the stationary wearing of the shoe. Thermocouples placed inside and outside of the shoe measured the inside and outside temperatures at the shoe's sole.

The testing produced results as follows:

TABLE 1

| | Approximate Test Temperature of 300 degrees F. | | | | | |
|---|---|---|---|---|---|---|
| | Degrees F. Simulated Pumping | | | Degrees F. No Pumping | | |
| Time* | Outside | Inside | Diff. | Outside | Inside | Diff. |
| Initial: 5 min. | 280 | 90 | 190 | 286 | 82 | 204 |
| Final: 120 min. | 320 | 118 | 202 | 353 | 159 | 194 |
| Average Temps: | 314 | 109 | 205 | 320 | 128 | 192 |

*Readings taken every 5-10 minutes

TABLE 2

| | Approximate Test Temperature of 400 degrees F. | | | | | |
|---|---|---|---|---|---|---|
| | Degrees F. Simulated Pumping | | | Degrees F. No Pumping | | |
| Time* | Outside | Inside | Diff. | Outside | Inside | Diff. |
| Initial: 5 min. | 341 | 95 | 246 | 295 | 88 | 207 |
| Final: 120 min. | 389 | 130 | 259 | 411 | 189 | 222 |
| Average Temps: | 372 | 119 | 253 | 373 | 151 | 222 |

*Readings taken every 5-10 minutes

The tests showed that:

a test temperature of 400 degrees F. produced significantly lower inside temperature over time than testing at 300 degrees F.;

testing of the shoe with the pumping action, simulating actual use of the shoe, yielded lower inside temperature as compared with testing without the pumping action;

whether simulating walking action or simulating the shoe at rest, the testing yielded significantly lower inside temperatures as compared with the outside temperatures.

Thus, the proposed embodiment provides significantly lower inside shoe temperatures for the wearer, while walking over intensely hot asphalt or tar or other road material.

The prior art shoes or boots use various ventilating systems for shoes, with venting points located in various areas of the shoe, and some disclose air ventilating tubes or conduits. They increase comfort and reduced perspiration for the wearer. However, none of the inventions in the prior art utilized reflective material specifically combined with a venting system to reduce inside shoe temperature for the wearer.

The present invention utilizes a compression and ventilating system to prevent heat injury to the wearer. This ventilating system, combined with reflective material, results in lower inside shoe temperatures, thus making the present invention a novel improvement over the prior art and highly useful for road workers and other persons walking over hot surfaces.

Although the present invention has been described in specific embodiments as noted herein, it is understood that those are for illustration only. Various other embodiments may be made without departing from the spirit and scope of the invention as recited in the appended claims.

I claim:

1. A heat resistant work shoe comprising an upper body and a lower sole portion having a lower outer sole, an upper inner sole and a lower inner sole, a squeezable, bendable insert and a heat collection chamber permitting air circulation within and out of said shoe, said upper body insulated on said interior wall with spongy material, a collar above said upper body, said upper body having both an outer leather surface and an inner leather surface, said outer leather surface having at least one row of ventilation holes at a top portion of said upper body of said shoe, said at least one row of ventilation holes located beneath said collar;

said ventilation holes communicating with a space between said outer leather surface and said inner leather surface of said upper body;

a toe region of said upper body containing fibrous insulation material between said outer and said inner leather surfaces, said fibrous insulation material permitting air to circulate in a space between said two leather surfaces, said space also containing flexible spacing bodies, said spacing bodies permitting a circulation and flow of air above said lower outer sole, between said inner and outer leather surfaces, and out of said shoe through said at least one row of ventilation holes at said top portion of said upper body;

a first reflective material within said lower sole portion of said shoe, said first reflective material reflecting radiant heat away from a wearer's foot;

said lower sole portion including said upper inner sole spaced apart from said lower inner sole;

a lining covering a top of said upper inner sole, which said lining covering said upper inner sole contacts said wearer's foot, said space between said upper inner sole and said lower inner sole capable of receiving said squeezable, bendable insert, said insert having projecting therefrom a plurality of small, resilient supporting spaced apart bodies of a same material as said insert, which said bodies permit air circulation within said sole below said upper inner sole and above said lower inner sole;

a wall surrounding said insert and said compressible supporting bodies of said insert, said wall having a vertically extending height approximately equal to a vertically extending height of said insert contained therein, said first reflective material below said upper inner sole and above said lower inner sole, said upper inner sole being positioned above and said lower inner sole being positioned below respectively said squeezable, bendable insert;

said wall containing a plurality of holes, each said hole containing a small, upwardly bent tube, said tubes allowing inlet and outlet of air from said heat collection chamber, said heat collection chamber responsive to compression of said insert for transferring said air to an area between said upper inner and upper outer leather surfaces of said shoe, resulting in a flow of air through said ventilation holes at said top portion of said upper body, a second reflective material between said inner and said outer surfaces of said upper portion of said shoe, said second reflective material coinciding with a curvature of said upper upper, a heat absorbing layer lying beneath said lower inner sole;

a fabric disposed to a bottom of said lower inner sole, said fabric surrounding said heat absorbing layer and said fabric holding said layer in place below said lower inner sole and above said lower outer sole; and a means to ventilate hot air from said heat collection chamber, said means including said supporting bodies being compressible for forcing air up through said tubes and out of said ventilation holes at said top portion of said upper body, thereby deflecting built-up heat away from a wearer, said compressible bodies expandable to bring cooler, outside air back through said vents into said lower sole portion.

2. The heat resistant work shoe as in claim 1 wherein said flexible spacing bodies are circular.

3. The heat resistant work shoe as in claim 1 wherein said upper inner sole is lighter in weight than said lower inner sole.

4. The heat resistant work shoe as in claim 1 wherein said flexible spacing bodies are cylindrical.

5. The heat resistant work shoe as in claim 1 wherein said fabric comprises a border stitched to said lower inner sole.

* * * * *